United States Patent [19]

Tschudin

[11] 4,194,658

[45] Mar. 25, 1980

[54] PAPER TOWEL DISPENSER

[76] Inventor: Arlow H. Tschudin, 10875-64th Ave., Allendale, Mich. 49401

[21] Appl. No.: 926,417

[22] Filed: Jul. 20, 1978

[51] Int. Cl.[2] ..... B26F 3/02

[52] U.S. Cl. ..... 225/65; 225/66; 225/77

[58] Field of Search ..... 225/65, 66, 56, 77, 225/78, 42; 206/818

[56] References Cited

U.S. PATENT DOCUMENTS

| | | | |
|---|---|---|---|
| 2,175,835 | 10/1939 | Fraser | 225/77 |
| 3,059,767 | 10/1962 | Chalfin | 206/818 X |
| 3,176,892 | 4/1965 | Waltz | 225/66 |
| 3,237,827 | 3/1966 | Domenico et al. | 225/42 |
| 3,378,184 | 4/1968 | Mallory | 225/66 |

FOREIGN PATENT DOCUMENTS

| | | | |
|---|---|---|---|
| 1511483 | of 1969 | Fed. Rep. of Germany | 225/77 |
| 6523 | of 1902 | United Kingdom | 225/77 |
| 886747 | of 1962 | United Kingdom | 225/66 |

*Primary Examiner*—Frank T. Yost

*Attorney, Agent, or Firm*—Price, Heneveld, Huizenga & Cooper

[57] ABSTRACT

A paper towel dispenser includes a T-shaped base with the center leg defining a handle permitting the dispenser to be hand held for portability. The base further includes structure for demountably attaching the dispenser to a wall or other object. A pair of support arms extend from the opposite ends of the cross bar of the base to support a roll of towels therebetween and a retainer and cutter bar extends between the support arms at the end remote from the base for preventing the roll of towels from inadvertently unwinding and for providing a cutter against which the towels can be individually torn from the roll.

11 Claims, 3 Drawing Figures

PAPER TOWEL DISPENSER

BACKGROUND OF THE INVENTION

The present invention relates to dispensers and particularly to an improved dispenser for use in dispensing rolled sheet material.

Paper towels in rolls are a common household convenience typically being mounted by a rack secured to a kitchen cabinet or wall. Their usefulness extends, however, to environments other than the kitchen and frequently it is desirable to use paper towels in other areas such as for washing windows of an automobile, cleaning up spills in the garage, for picnics, camping, or any number of other remote locations where their ability to absorb liquids is useful. Since typically the towel racks are permanently mounted, the user usually removes the roll of paper towels to the remote working area. In so doing, the towels, without a rack support, become difficult to handle since if laid on an inclined surface they tend to unroll or if working in a wet area, the entire roll of towels can become soaked due to their rapid moisture absorbing capabilities. Thus, the normal convenience of the paper towels sometimes is outweighed by the inconvenience of handling a loose roll of towels.

Thus, there exists a need for a portable paper towel rack which can be used equally well as a demountable rack in the kitchen or other fixed location but removed to provide a stand for the dispensing of towels at a remote location or provide a ready mounting system for removably mounting the towels at a remote location.

SUMMARY OF THE PRESENT INVENTION

The paper towel dispenser of the present invention provides a portable stand and towel dispenser which can be used as a free standing dispenser, a hand held dispenser. or a wall or other surface mounted dispenser. With such a dispenser, the paper towels can be easily moved from one location to another, greatly facilitating the use of paper towels or other rolled sheet material in remote locations.

Paper towel dispensers embodying the present invention include a base having an integral handle such that the dispenser can be supported on the base, on a surface, or hand held. Extending from the base is a pair of towel support arms. A towel retainer and cutter bar extends between opposite ends of the arms remote from the base preventing unwinding of the towels and providing an edge against which the towels can be individually torn from the roll. In the preferred embodiment, the base includes means for demountably attaching the base to a wall or other surface. In one embodiment of the invention, the base includes magnetic attachment means such that the base can be removably secured to a ferromagnetic surface.

These features, advantages, and objects of the present invention can best be understood by reading the following description thereof together with reference to the drawings, in which:

DETAILED DESCRIPTION OF THE PREFERRED EMBODIMENT

Figure 1:
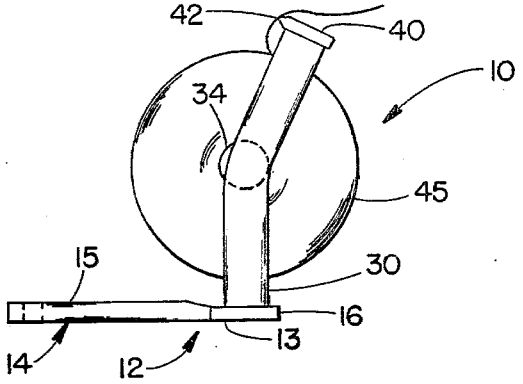
FIG. 1 is a right side elevational view of a towel dispenser constructed according to the present invention.
Figure 3:
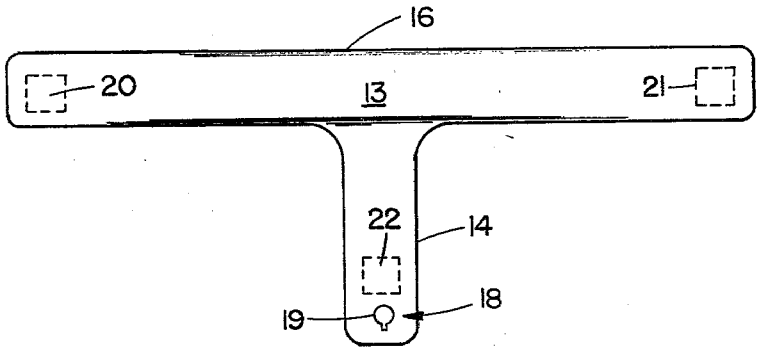
FIG. 3 is a bottom plan view of the base portion of the dispenser shown in FIGS. 1 and 2.

Referring to the figures, there is shown a towel dispenser 10 constructed according to the present invention. The dispenser includes a base 12 of generally T-shaped configuration (FIG. 3) having a center leg 14 and an integrally formed cross bar 16. The center leg 14 defines a handle suitable for hand holding the dispenser. The base so formed has a flat bottom surface 13 permitting the base to be positioned on a support surface and be free standing. Handle 14 has, as seen in FIG. 1, a thickness which is approximately twice that of the cross member 16 to provide additional weight for permitting free standing of the stand and also providing a comfortable handle.

The support base 12 further includes means 18 for demountably securing the base to a wall. In the embodiment shown, means 18 comprises a keyhole shaped aperture 19 having a large circular portion and a slot such that the circular portion of aperture 19 can be fit over a nail or screw head and the base then, subsequently, lowered to lock the base to the fastening means such that the screw or nail head extends over the slot and lock in engagement with the upper surface 15 of handle 14. In addition to aperture 19, the demountable attachment means 18 may also include permanent magnets 20, 21, and 22 (shown in phantom form in FIG. 3) which are permanently bonded to the ends of cross arm 16 and to the handle near aperture 19 such that base 12 can be secured to a ferro-magnetic material. Thus, the dispenser can be attached, for example, to a refrigerator door, a portion of an automobile, or other metallic object. Magnets 20, 21, and 22 preferably are relatively flat and thin so as not to interfere with the ability of the dispenser to stand freely on a horizontal surface. Commercially available magnetic material is suitable for such application and can be bonded to the base with a suitable adhesive.

Figure 2:
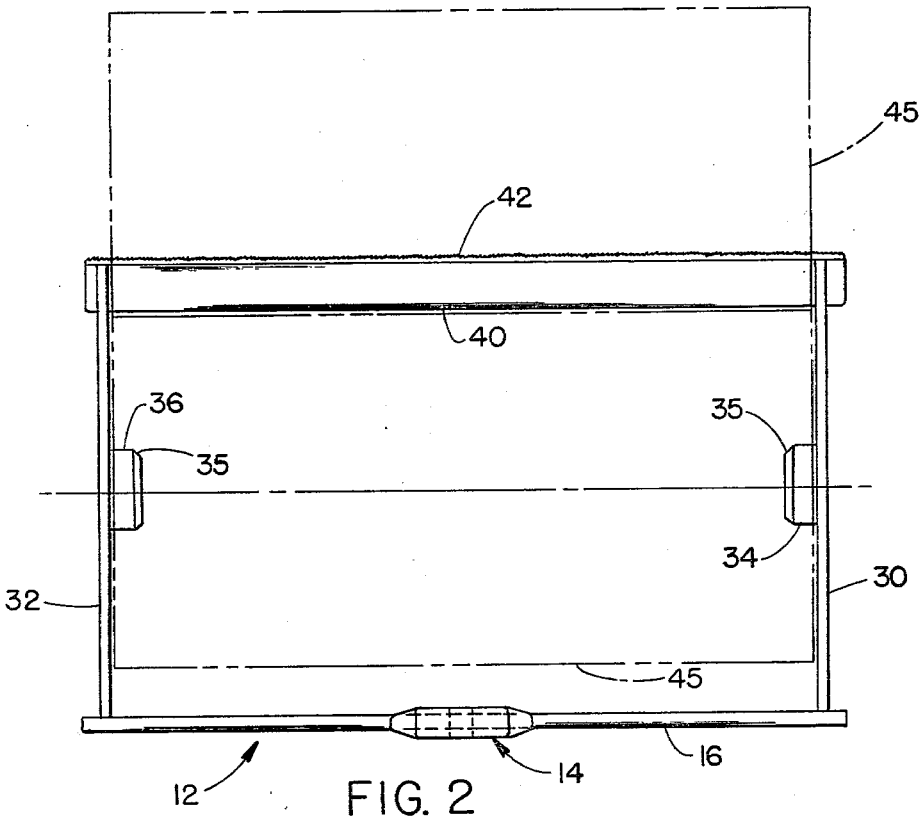
FIG. 2 is a front elevational view of the dispenser shown in FIG. 1.

Extending upwardly and outwardly from the base is a pair of spaced support arms 30 and 32, each having one end secured to an end of cross arm 16. As seen in FIG. 2, cross arms 30, 32 extend in spaced, parallel planes which are perpendicular to the plane defined by the flat bottom surface 13 of base 12. Arms 30 and 32 are spaced approximately 11¼" apart to permit a standard 11" roll of paper towels (45) to fit between the arms. Approximately midway along the length of arms 30 and 32 are integrally attached tube support members 34 and 36 which extend inwardly and are tapered at ends 35 to permit the center support tube of a paper towel roll to easily be fitted over the support members. For insertion of the roll of paper towels, arms 30 and 32 preferably are made of a resilient material permitting outwardly flexing to accommodate the roll of towels within the support members 34 and 36.

At the end of legs 30 and 32 remote from base 12 there is provided a cross bar 40 of generally rectangular construction and having a serrated cutting edge 42 extending along its length and facing generally rearwardly and upwardly with respect to the base. Bar 40 provides the dual function of preventing the paper towels to inadvertently unravel from the roll as well as providing a tear bar against which individual towels can be removed from the roll by an upwardly and outwardly directed pulling motion. Preferably, the towel dispenser is made of a resilient polymeric material such as high impact polyethylene or the like and the base 12, arms 30 and 32, and cross bar 40 can be molded and subsequently joined using a commercially available bonding adhesive suitable for use with the resilient polymeric material employed.

Naturally, the towel dispenser can also be made of wood or other suitable material although it is desirable that arms 30 and 32 be sufficiently resilient to permit easy insertion of a roll of paper towels. If desired, handle 14 may include a core of weighting material such as lead or other relatively heavy material to provide additional stability for the free standing dispenser.

In use, the dispenser can, as noted above, be secured using a suitable fastening screw or nail or, in the alternative embodiment, be attached to a ferro-magnetic surface. The towel dispenser is easily removed and can be carried to remote locations by use of the handle 14. At a remote location, the towel can be removed from the dispenser by holding the dispenser with the handle or by resting the dispenser with the base on a support surface. In such case, it is usually required to provide hand pressure against the upper surface of handle 15 when tearing a towel from the dispenser. As noted above, the dispenser is easily attached to a metallic object such as an automobile and when demountably attached, a towel can be easily removed without otherwise supporting the dispenser.

It will become apparent to those skilled in the art that the above noted and other modifications to the preferred embodiment described and disclosed herein can be made without departing from the spirit or scope of the invention as defined by the appended claims.

The embodiments of the invention in which an exclusive property or privilege is claimed are defined as follows:

1. A dispenser for roll sheet material comprising:

a base including a handle, said base having a flat bottom surface and an upper surface, said bottom surface permitting free standing of the dispenser on a generally horizontal surface;

a pair of support arms extending from said base in spaced relationship for receiving a roll of sheet material therebetween, each support arm extending in a plane perpendicular to a plane defined by the flat bottom surface of said base; and a cross bar coupled to the ends of said support arms remote from said base for preventing the unraveling of rolled sheet material and for providing a tear strip against which segments of the sheet material can be removed from the roll.

2. The dispenser as defined in claim 1 wherein said base includes means for demountably attaching said base to an object.

3. The dispenser as defined in claim 2 wherein said base comprises a T-shaped member having a center leg defining said handle for the dispenser and a cross arm, said cross arm supporting said support arms at opposite ends thereof, said center leg weighing more than said cross arm to facilitate free standing.

4. The dispenser as defined in claim 3 wherein said support arms are made of a resilient material.

5. The dispenser as defined in claim 4 wherein said base is made of a resilient polymeric material.

6. The dispenser as defined in claim 5 wherein said cross bar includes a serrated edge facilitating tearing of sheet material from a roll material held by said dispenser.

7. The dispenser as defined in claim 6 wherein said dispenser is made of polyethylene.

8. The dispenser as defined in claim 1 wherein said base includes means for demountably securing said dispenser to an object and wherein each of said support arms extends upwardly and outwardly from said base when said base is on a horizontal surface, said arms each including tube support members, said tube support members extending inwardly and having tapered ends.

9. The dispenser as defined in claim 8 wherein said means for demountably securing the dispenser comprises an aperture formed in said handle.

10. The dispenser as defined in claim 9 wherein said aperture is keyhole shaped.

11. The dispenser as defined in claim 8 wherein said means for demountably securing said dispenser to an object includes magnetic means secured to the undersurface of said base for attachment of the dispenser to ferro-magnetic objects.

* * * * *